United States Patent [19]

Lloyd et al.

[11] 3,936,583

[45] Feb. 3, 1976

[54] PREVENTION OF CORROSION IN METALS

[75] Inventors: Geoffrey Oliver Lloyd, Twickenham; John Ernest Rhoades-Brown, Hanworth; Stuart Richard John Saunders, New Malden, all of England

[73] Assignee: Secretary of State for Trade & Industry in Her Britannic Majesty's Govt. of U.K. of Gt. Britain & Northern Ireland, London, England

[22] Filed: Oct. 25, 1973

[21] Appl. No.: 409,592

[30] Foreign Application Priority Data

Oct. 26, 1972 United Kingdom ..... 49460/72

[52] U.S. Cl. ..... 428/450; 428/471; 428/539; 148/6.14 R; 148/6.15 R; 427/435

[51] Int. Cl.[2] ..... C23F 7/00

[58] Field of Search ..... 148/6.15 R, 6.14 R, 6; 117/127; 427/435

[56] References Cited

UNITED STATES PATENTS

| | | | |
|---|---|---|---|
| 2,952,562 | 9/1960 | Morris et al. | 117/127 X |
| 3,133,829 | 5/1964 | Cupery et al. | 117/127 |
| 3,197,345 | 7/1965 | Vullo et al. | 148/6.15 R |
| 3,338,754 | 8/1967 | Vullo | 148/6.15 R |
| 3,530,012 | 9/1970 | Nakamura et al. | 148/6.15 R |
| 3,677,796 | 7/1972 | Girard et al. | 117/127 X |
| 3,796,608 | 3/1974 | Pearlman | 117/6.14 R |

FOREIGN PATENTS OR APPLICATIONS

| | | |
|---|---|---|
| 1,094,210 | 12/1967 | United Kingdom |

*Primary Examiner*—Harris A. Pitlick

*Attorney, Agent, or Firm*—Stevens, Davis, Miller & Mosher

[57] ABSTRACT

A method of protecting an article having at least a surface layer of an alloy of iron and/or nickel which contains at least 1 per cent of chromium, against high temperature oxidation, by contacting the article with a solution or a suspension of a borate and/or a phosphate in a volatile polar organic solvent so that, after removal of the solvent, a film weighing at least 3 $\mu$ g / cm$^2$ of the borate and/or phosphate material is deposited on the surface of the article.

7 Claims, No Drawings

PREVENTION OF CORROSION IN METALS

This invention relates to a process for the diminution of high temperature oxidation of iron and nickel alloys containing chromium and the articles made from said alloys protected by the method of the invention.

The expression high temperature oxidation as used in this specification is defined as oxidation which occurs on surfaces of metal at temperatures in excess of about 500°–600°C when these surfaces are in contact with air, carbon dioxides or other oxidising gases, for instance the gaseous products of combustion of coal or fuel oil.

As the result of high temperature oxidation, a protective film may be formed. This film often retains its protective properties for a limited period, after which the rate of oxidation accelerates rapidly. The acceleration may occur at constant temperature or may be due to cracking or flaking as a result of temperature changes. Subsequent oxidation is usually rapid and may lead to the complete destruction of the metal in a short time.

The process of the present invention provides a prolongation of the initial protective period by a cheap and simple means which greatly delays or prevents the destructive accelerated oxidation. It is therefore difficult to set a lower limit to the oxidation temperature at which the process of the invention is effective as the normal protective period will in any case be comparatively long at tempertures below about 600°C. In practice however, few problems arise at temperature below about 600°C when using conventional materials and the process of the invention confers little practical benefit at these temperatures. The upper limit for the temperature of oxidation will depend on the material used but, for most known materials, it lies within the temperature range about 800° to about 1000°C.

This high temperature oxidation does not include oxidation of metal surfaces at lower temperatures usually in the presence of water normally resulting in the formation of a scale of hydrated oxide. This type of oxidation, commonly known as rusting, does not form a protective coating so that the metal will be progressively consumed.

The expression Article as used in this specification includes surfaces of the alloy as such and also objects or structures fashioned or partly fashioned from the alloys so that at least the surface layer of the object or structure is an alloy of iron or nickel containing at least 1 per cent of chromium.

Many processes for controlling the growth of oxide are known and they include alloying with expensive materials such as chromium and nickel, and the application of protective barriers. Generally, if protection of alloys or structures made from them is required over months or years thick barriers are applied or large amounts of expensive alloying materials are necessary. These thick barriers may be vulnerable to mechanical damage. For short term protection, for instance during heat treatment, a thinner deposit may be applied which while giving some protection may nevertheless permit the formation of a thick scale. This scale usually needs to be removed, or it may remove itself on cooling, but in any case one does not get long term protection by this method especially in conditions involving thermal cycling.

One example of a process for controlling the formation of scale is disclosed in British Pat. No. 1,094,210 which described a method comprising contacting the surface with an aqueous preparation containing at least 0.1% by weight of boric acid or phosphate anion to form a thin deposit on the metal surface. This process reduces the thickness of scale formed during heat treatment between 800° and 1,650°F (approximately 425°–900°C) but a thick scale is nonetheless formed, and is removed by some subsequent treatment such as acid pickling. It is stated that it is essential to use boric acid as the borate anion is not effective and therefore the salts of boric acid should not be used. This method has the disadvantages that the protection given by the treatment may be erratic due to uneven application of the boric acid or phosphate ion and the oxidation changes the external dimensions of the metal being protected. Furthermore this method is intended to give temporary protection for periods of several hours at most.

It has now been found that iron and nickel alloys containing chromium may be given long term protection against high temperature oxidation at fixed temperature or with thermal cycling without the formation of appreciable amounts of scale and without substantially altering the dimensions of the metal, by contacting the metal with a solution or suspension of a borate and/or a phosphate in a volatile polar organic liquid.

According to the invention, there is provided a process for the protection of an article having at least a surface layer of an alloy of iron and/or nickel, which contains at least 1 per cent by weight of chromium, against high temperature oxidation comprising contacting the said article with a solution or a suspension of a borate and/or a phosphate in a volatile polar organic solvent whereby, after removal of the solvent, a film weighing at least $3\mu g/cm^2$ of the borate and/or phosphate material is deposited on the surface of the article.

Preferably the chromium is present in the alloy in the range about 3–30% by weight. The process may also be applied to alloys with lower chromium contents.

Preferably borate is deposited and the preferred borate is borax.

An important factor in obtaining protection is to secure a deposit of inhibitor of adequate thickness and even distribution and however applied, the solvent should be removed from the deposit sufficiently quickly to ensure that the deposit is substantially evenly applied. The expression volatile, as used in the specification, includes not only low boiling solvents such as the lower aliphatic alcohols for instance, methyl alcohol, ethyl alcohol, n-propyl alcohol, iso-propyl alcohol, and, n-, iso-, and t-butyl alcohols, acetone, methylethyl ketone, 1.4 dioxane but also higher boiling solvents such as ethylene glycol. A preferred solvent is methyl alcohol. In all cases conventional means for removing solvents, for instance heat or the passage of a gas or a combination of both these factors may be employed.

Solutions of the inhibitors have been used up successfully in the range of concentration $5 \times 10^{-3}$ molar to $3 \times 10^{-1}$ molar.

It has been found as previously stated, to give any substantial improvement in protection that the lower limit for the deposit should be $3\mu g/cm^2$ of surface area. The upper limit to the amount of deposit is dependent upon factors such as cost, the practical thickness of deposit permissable, or the desirable 'life' of the alloy could influence the economic thickness of the deposit.

As used in this specification, the expression "polar organic solvent" also includes such solvents containing up to about 50% of water. It will be realised that solution of a hydrated salt in such a solvent could produce a solution of water in the solvent. Sufficiently heavy films of deposit may be obtained by applying a solution or suspension of the borate and/or phosphate to the alloy, for example by brushing or spraying, but it may be more convenient to apply homogeneous solutions. In this case, with some of the polar organic solvents, it may be necessary to add water to the solvent to ensure a sufficiently high concentration of solute.

The expression "borate and/or phosphate" includes all the various borate salts and esters such as of ortho-, meta- and pyro-borates as well as the acids associated with them, and phosphates include salts and esters such as ortho-, meta-, pyro-, and hypo-phosphates and ortho-, pyro-, meta- and hypo-phosphites as well as the acids associated with them.

In a further embodiment of the invention, the solution or suspension of the borate and/or the phosphate may also contain other materials such as silica and tetraethylorthosilicate.

The alloys may be cleaned and degreased before they are contacted with the required solution. Good results have, however, been obtained without such preparation and alloys covered with a thin layer of rust have been successfully protected.

A preferred method of contacting the alloy with the volatile polar organic solvent solution is by immersing the whole of the alloy into the solution ensuring that all parts of the surface are wetted. Other methods such as brushing, rolling or spraying as for instance a fine spray in a carrier gas may also be used. A simple and convenient way of applying a deposit to the inside of a hollow structure would be to fill the structure with a homogeneous solution of the inhibitor, draining the solution from the structure and thereafter removing the solvent.

The volatile solvent may be removed by any known method, preferably in such a way, that operating personnel are not affected and the solvent is recovered.

The treated articles may then be exposed to the high temperature oxidising environment. Alternatively the treated articles may be stored for a period prior to being exposed to the high temperature environment. It should be realised that the deposit on the treated article is mechanically stronger after high temperature treatment than prior to it and if such storage involves handling which might damage the deposit, it would be advantageous to heat the treated article at temperatures in excess of about 400°C immediately after treatment.

The protective coatings given by the method of the invention are not broken by thermalcycling, and if the layer is broken by mechanical abrasion a protective layer is reformed with no apparent loss of protection. Further if such protected specimens are washed in water, no deleterious effects are observed.

The invention also includes articles made or iron and nickel alloys treated by the process of the invention and which are subjected to temperatures at which high temperature oxidation can occur.

In order that the invention may be better understood, it will be described, by way of illustration, by reference to the following examples which give details of tests carried out.

EXAMPLE 1

Strips of nickel and iron alloys, about 1.2 cm by 1.2 cm and about 150 μm thick, were immersed in various solutions or suspensions for about 30 seconds, dried with hot air and oxidised for varying times at temperatures in the range 600°–1000°C. The oxidising procedure consisted in heating the treated strips in air in an electrically heated furnace. The examination included visual and microscopic observations and measurements by microbalance of the amount of inhibitor deposited on the strip and the thickness of the oxide film produced. The thickness was calculated from the increase in weight of the specimen on applying the film and by dividing the film weight per unit area by the density of the deposit. The lightest coating applied — 0.05 μm — corresponded to a deposit weight of 8 $\mu g/cm^2$. Similarly, the thickness of the oxide was calculated from the weight gained on oxidation and the known density of the oxide produced.

The results are given in the accompanying Table.

The stainless steel type 304 contained 18 to 20% chromium and 8 to 12% nickel the rest apart from minor constituents being iron. The analysis of Nimonic (Trade Mark) 90 was 18% chromium, 15% cobalt, 0.8% aluminum, 1.8% titanium, 1.0% manganese, 3.0% iron, 1.5% silicon with the balance primarily nickel.

EXAMPLE 2

Strips of 10 percent chromium iron and Nimonic 90 were immersed in a solution of borax in methanol, dried and oxidised in a test rig at 700°C in kerosene combustion products containing 100 p. p.m. of artificial sea salt.

The results were as follows:

| Material | Deposit Thickness μ m | Thickness of deposit and scale μ m 20 hr | 200 hr | 400 hr |
|---|---|---|---|---|
| Fe/10% Cr | none | 47 | 150 | |
| | 0.5 | 19.5 | 47.5 | 58.5 |
| | 2.0 | 16.5 | 40.0 | 46.0 |
| Nimonic 90 | none | 0.05 | 3.7 | 4.2 |
| | 0.5 | 0.58 | 2.8 | 3.1 |
| | 2.0 | 2.70 | 3.7 | 4.0 |

It will be noted that the untreated iron/chromium alloy was completely destroyed in 200 hours at 700°C whereas the same alloy coated with borax showed a comparatively little increase in oxidation between 200 and 400 hours.

| Test No. | Alloy | Inhibitor | Temp. °C | Deposit Thickness μm | Total Thickness of Oxide and Inhibitor, μm 20 hr | 200 hr | 1,000 hr | 10,000 hr | |
|---|---|---|---|---|---|---|---|---|---|
| 1 | Fe/10% Cr | None | 600 | — | 2.8 | 16.0 | 80.0 | 140.0 (3000 hr) | |
| 2 | Fe/10% Cr | Borax/MeOH $10^{-1}$M | 600 | 0.6 | 0.6 | 0.8 | 0.8 | 1.0 | |
| 3 | Fe/10% Cr | Borax/MeOH $10^{-1}$M | 600 | 0.6 | 0.7 | (damaged 70 hr) 1.6 | 0.6 | 0.5 | (17,000 hr) 0.5 |
| 4 | Fe/10% Cr | Borax/MeOH $10^{-1}$M | 600 | 0.6 | 0.6 | (washed 24 hr) 0.8 | 0.7 | 0.7 | (17,000 hr) 0.7 |

-continued

| Test No. | Alloy | Inhibitor | Temp. °C | Deposit Thickness μm | Total Thickness of Oxide and Inhibitor, μm 20 hr | 200 hr | 1,000 hr | 10,000 hr | |
|---|---|---|---|---|---|---|---|---|---|
| 5 | Fe/10% Cr | $H_3PO_4$/MeOH $10^{-1}$M | 600 | 0.14 | 0.3 | 0.7 | 1.4 | 6.0 (2300 hr) | |
| 6 | Fe/10% Cr | $H_3PO_4/H_2O$ $10^{-1}$M (water) | 600 | Etched | 3.0 | 20.0 | (300 hr) 30.0 | | |
| 7 | Fe/10% Cr | Na hexamet phosphate | 600 | 13.8 | 12.5 | 13.8 | 18.0 | | |
| 8 | Fe/10% Cr | (MeOH) Na metaborate Saturated | 600 | 1.2 | 3.0 | — | (732 hr) 3.6 | | |
| 9 | mild steel | None | 600 | — | 14.5 | (flaking) 23.1 | | | |
| 10 | mild steel | Saturated Borax/MeOH | 600 | 2.0 | 3.7μm | 23μm | | | |
| 11 | Fe/1% Cr | None | 600 | — | 17 | 36 flaking | — | | |
| 12 | Fe/1% Cr | Saturated Borax/MeOH | 600 | 1.2 | 7.7 | 19.7 | (390 hr) 32.7 | | |
| 13 | Fe/5% Cr | None | 600 | — | 4.8 | 22.7 | 59 | 132 (4000 hr) | |
| 14 | Fe/5% Cr | Saturated Borax/MeOH | 600 | 1.5 | 3.2 | 4.0 | 5.7 | 16.8 (4000 hr) | |
| 15 | Fe/3% Si | None | 600 | | 2.3 | 4.6 | (720 hr) 7.0 | | |
| 16 | Fe/3% Si | Saturated Borax/MeOH | 600 | 1.2 | 1.5 | 3.3 | (720 hr) 4.6 | | |
| 17 | Fe/10% Cr | Boric Acid/ MeOH — M | 600 | 0.03 | 0.68 | 1.14 (66 hr) | 27 | | |
| 18 | Fe/5% Al | | 600 | | flaking 3.6 | | | | |
| 19 | Fe/5% Al | Saturated Borax MeOH | 600 | 1.5 | 3.4 | | | | |
| 20 | Fe/10% Cr | None | 800 | — | 2.0 | 80 (40 hr) | | | |
| 21 | Fe/10% Cr | Borax/MeOH $10^{-1}$M | 800 | 0.4 | 1.2 | 1.3 | 1.4 | 2.0 | |
| 22 | Fe/10% Cr | Borax/MeOH $10^{-2}$M | 800 | 0.05 | 0.6 | 6.0 | 10.0 | 17.0 | |
| 23 | Fe/10% Cr | Borax/water $10^{-2}$M | 800 | 0.15 | 2.4 | 2.8 | (500 hr) 60.0 | | |
| 24 | Fe/10% Cr | Borax ($10^{-1}$M)$H_3PO_4$ ($10^{-2}$M)MeOH | 800 | 0.4 | 5.0 | 5.0 | 5.0 | 5.1 | |
| 25 | Fe/10% Cr | Zn. borate 5% Suspension in MeOH | 800 | 0.4 | 0.84 | 1.0 | 1.5 | | |
| 26 | Fe/20% Cr | None | 800 | — | 0.74 | 1.21 | 1.56 | 2.42 | |
| 27 | Fe/20% Cr | Borax/$10^{-1}$M MeOH | 800 | 0.5 | 0.7 | 0.9 | 1.0 | 1.3 | |
| 28 | Fe/20% Cr | None | 900 | — | completely oxidised (24 hr) | | | | |
| 29 | Fe/20% Cr | Saturated Borax/MeOH | 900 | 4.0 | 18.7 | 19.75 | 21.4 | (2.400hr) 24.4 | (3.700hr) flaked |
| 30 | Fe/20% Cr | None | 1000 | — | 36.0 | (70 hr) 140.0 | | | |
| 31 | Fe/20% Cr | $10^{-1}$M Borax/MeOH | 1000 | 5.2 | 20.0 | 60.0 | (300 hr) 140.0 | | |
| 32 | Stainless Steel Type 304 | None | 900 | — | flaking | | | | |
| 33 | Type 304 | (Saturated) Borax/MeOH | 900 | 2.6 | 4.1 | 7.5 | 10.0 | (2.600 hr) 17.0 | |
| 34 | Type 304 | 10% $Sio_2$ in Saturated Borax/ MeOH | 900 | 6.0 | 6.0 | 9.0 | | | |
| 35 | Nimonic 90 | None | 900 | — | flaking | | | | |
| 36 | Nimonic 90 | 10% $Sio_2$ in Saturated Borax/ MeOH | 900 | 12.0 | 12.0 | 12.5 | | | |

EXAMPLE 3

Strips of 10 per cent chromium iron were dipped in $10^{-2}$M aqueous sodium chloride solution so as to deposit 1.3 μ g/cm² of sodium chloride. On oxidation in air at 800°°C, the alloy was almost completely destroyed (oxide thickness about 130 μm) in 20 hours.

Similar strips dipped in a saturated solution of borax in methanol to which was added sodium chloride ($10^{-2}$M on solution) so as to deposit a thickness of 3.7 μm were similarly oxidised in air at 800°C to produce the following thickness of oxide.

| 20 hrs | 200 hr | 1000 hr | 2750 hr |
|---|---|---|---|
| 30 μm | 36 μm | 36.5 μm | 36.7 μm |

EXAMPLE 4

Strips of 10 per cent chromium iron were dipped in a saturated solution of borax in methanol dried and oxidised in flowing carbon dioxide at 600°C (pressure, 1 atmosphere).

The thickness of scale were as follows

| | deposit thickness | 119 hr | 1115 hr |
|---|---|---|---|
| No inhibitor | — | 46.2 μm | 86.9 μm |
| borax | 1.6 μm | 13.2 μm | 26.6 μm |

The results given in the example are briefly discussed below.

It will be realised that when material is lost by etching or by detachment of oxide, the calculation of thickness of films is unrealistic. Furthermore, the scale thickness developed on oxidation include the thickness of the original deposit of the inhibitor.

The degree of protection conferred by the process of the invention depends on the chromium content of the alloy. Thus the improvement obtained at 600°C with mild steel (Example 1 Tests 9 and 10); 1% Chromium iron alloy (Example 1 Tests 11 and 12) and Fe/Si and Fe/Al alloys (Example 1 Tests 15, 16, 18 and 19) were comparable with that claimed in the prior art. The improvement with 5% Cr. iron was substantial and with the iron alloys containing 10 and 20% Cr., the useful operating temperature increases steadily with increasing chromium content.

The protection obtained with polar organic solutions is considerably better than that obtained with aqueous solutions both with added borate and phosphoric acid.

The process of the invention prevents flaking on alloys normally subject to this defect and therefore the comparisons may be somewhat unfavourable to the alloy protected by the process of the invention.

The results given in Examples 2, 3 and 4 show that the process of the invention may be applied to reduce oxidation which occurs in atmospheres other than air, for instance in carbon dioxide, vitiated combustion atmospheres and with salt laden atmospheres.

Many of the tests have been continued for some 20,000 hours with little change in scale thickness beyond those quoted. In one test, owing to a failure of the temperature control of the furnace, the specimens were heated to about 1000°C for 33 hours after having been heated for about 10,000 hours at 800°C without any deleterious effects. A similar alloy when heated at 900°C had a useful life of only 13 hours at 900°C and it would seem that the heat resisting capability of the protective layer improves considerably during service.

Scale thicknesses developed by the process of the invention are for the most part very small, and scales usually grow only for a short time, with almost complete absence of subsequent growth. Scales are smooth, adherent, and resistant to damage, and deliberately inflicted damage does not lead to failure. Specimens were withdrawn from the furnace at intervals: some have been temperature-cycled 25 times with no apparent effect.

What we claim is:

1. A process for the protection of the surface of an article, said surface being an iron or nickel alloy which contains at least 1 per cent by weight of chromium, against high temperature oxidation comprising contacting the same article with a solution or a suspension of a material selected from the group consisting of borax, sodium metaborate, zinc borate and boric acid, in a volatile polar organic solvent, whereby, after removal of the solvent, a film weighing at least 3 $\mu g/cm^2$ of the said material is deposited on the surface of the article.

2. A process according to claim 1 wherein the chromium is present in the alloy in the range 3 to 30 per cent by weight.

3. A process according to claim 1 wherein the borate is borax.

4. A process according to claim 1 wherein the polar organic solvent is selected from the group consisting of methyl alcohol, ethyl alcohol, n-propyl alcohol, isopropyl alcohol, n-butyl alcohol, iso-butyl alcohol, t-butyl alcohol, acetone, methyl ethyl ketone, 1,4 dioxane and ethylene glycol.

5. A process according to claim 1 wherein the solution or suspension of a borate contains additionally silica or tetraethylorthosilicate.

6. An iron or nickel alloy treated by the process of claim 1.

7. A process for retarding the production of a scale by oxidation at a temperature of 600°C or above on an iron or nickel alloy containing at least 1 per cent by weight of chromium which comprises coating the surface of the alloy with a material selected from the group consisting of borax, sodium metaborate, zinc borate and boric acid, in a polar solvent and removing the solvent to leave a film weighing at least 3 $\mu g/cm^2$ of the borate on the surface of the alloy.

* * * * *